252-99 AU 165 EX
9/27/77 XR 4,051,055

United States Patent [19]

Trinh et al.

[11] 4,051,055

[45] Sept. 27, 1977

[54] CLEANSING COMPOSITIONS

[75] Inventors: Toan Trinh, Sharonville; Bruce Albert Yeazell, Springfield Township, Hamilton County, both of Ohio

[73] Assignee: The Procter & Gamble Company, Cincinnati, Ohio

[21] Appl. No.: 753,070

[22] Filed: Dec. 21, 1976

[51] Int. Cl.[2] ..... C11D 3/04; C11D 3/14; C11D 3/395; C11D 7/10

[52] U.S. Cl. ..... 252/95; 252/99; 252/102; 252/103; 252/131; 252/133; 252/140; 252/160; 252/173; 252/531; 252/535; 252/550; 252/554; 252/DIG. 14

[58] Field of Search ..... 252/89, 95, 99, 131, 252/140, 133, 531, 535, 550, 554, 186, 187, 102, DIG. 14, 173, 160

[56] References Cited

U.S. PATENT DOCUMENTS

| | | | |
|---|---|---|---|
| 1,894,207 | 1/1933 | Taylor | 252/99 |
| 2,285,676 | 6/1942 | Metziger | 252/99 |
| 2,571,690 | 10/1951 | Dobbelmann | 252/133 |
| 3,330,766 | 7/1967 | Goldwasser | 252/99 |
| 3,551,338 | 12/1970 | Rapisarda | 252/99 |
| 3,577,347 | 5/1971 | Monick | 252/99 |
| 3,630,922 | 12/1971 | McClain | 252/99 |
| 3,640,878 | 2/1972 | Chirash | 252/99 |
| 3,843,543 | 10/1974 | James | 25/187 H |
| 3,985,668 | 10/1976 | Hartman | 252/99 |

FOREIGN PATENT DOCUMENTS

| | | | |
|---|---|---|---|
| 685,393 | 4/1964 | Canada | 252/155 |

*Primary Examiner*—Dennis L. Albrecht
*Attorney, Agent, or Firm*—Ronald L. Hemingway; Douglas C. Mohl; Richard C. Witte

[57] ABSTRACT

Aqueous hypochlorite-containing cleansing compositions for use on porcelain enamel surfaces wherein said compositions contain a sufficient amount of water-soluble fluoride salt and a clay with cation exchange capacity to inhibit discoloration of the surface by the hypochlorite.

11 Claims, No Drawings

CLEANSING COMPOSITIONS

This invention concerns cleansing compositions and more specifically cleansing compositions which contain as an active ingredient a hypochlorite bleach and special additives whose presence impedes the discoloration of porcelain enamel surfaces which contain lead, said discoloration being caused by reaction between the lead and hypochlorite.

Oxidizing agents are frequently incorporated in present household cleansers and the use of hypochlorite is of particular interest in this context because of its powerful bleaching and germicidal properties. The use of hypochlorite at relatively high concentrations in clay-thickened aqueous hard surface scouring compositions is disclosed in U.S. Pat. No. 3,985,668, issued Oct. 12, 1976, to Hartman. Clay-thickened hypochlorite bleach solutions are also disclosed in U.S. Pat. No. 3,843,548, issued Oct. 22, 1974, to Jones; and U.S. Pat. No. 3,558,496, issued Jan. 26, 1971, to Zmoda. However, inasmuch as hypochlorites are powerful oxidizing agents, their utilization as cleanser components can also have drawbacks. In particular, it has been found that hypochlorite-containing cleansing compositions can cause considerable discoloration on porcelain enameled surfaces which contain lead (such as those in washbasins, sinks, bathtubs and the like) when the compositions, in concentrated liquid form, are brought into contact with said surfaces. (As used hereinafter, the term "enamel" will be understood to mean porcelain enamel.)

It is not quite clear why this should be the case. However, it it believed that when the concentrated hypochlorite-containing composition is brought into contact with the enameled surface, undissolved lead contained in the enamel becomes dissolved, diffuses to the surface and is oxidized by the hypochlorite to a colored insoluble compound which is either precipitated onto the enameled surface or absorbed into it, thereby resulting in an undesirable stain on the surface. This staining phenomenon has been found to occur in varying degrees of severity on different enamel surfaces. Presumably the severity of the stain is dependent upon the oxidizable lead content and/or the condition of the enamel surface.

Cleansing compositions which contain mild oxygen bleaches (e.g., sodium perborate) instead of hypochlorite do not bring about discoloration when used under similar conditions. This can probably be attributed to the fact that these oxygen bleaches are not sufficiently strong oxidizing agents to cause the oxidiation of the lead compounds contained in the enamel. Although oxyen bleaches might appear to offer advantages in comparison to hypochlorites in this respect, they are much less desirable overall, inasmuch as they are less efficient bleaches because their oxidation and bleaching action is not as strong. Accordingly, it is highly desirable to formulate cleansing compositions which contain hypochlorite in order to provide strong bleaching performance, but which do not cause objectionable staining of enamel surfaces.

The primary object of the present invention is to provide liquid hypochlorite compositions which can be used to clean procelain enamel surfaces and at the same time minimize the potential for staining due to chemical interaction of hypochlorite with the surface.

DETAILED DESCRIPTION OF THE INVENTION

According to the present invention it has been found that inclusion of a source of soluble fluoride ions (preferably a water-soluble fluoride salt) and a cation-exchange clay into aqueous hypochlorite-containing cleansing compositions, markedly reduces the tendency of such compositions to cause staining of enamel surfaces. Within the context of the present invention, the term "cleansing compositions" is intended to include compositions which clean by chemical bleaching action only, as well as those which combine bleaching action with abrasive action and/or detergency action. The term "clay" as used hereinafter means a mineral clay having a cation exchange capacity of at least 3 milliequivalents of cation per 100 grams of clay. The theory of how fluoride and clay work in reducing staining in these compositions is not completely understood. It is known that fluoride can form a relatively insoluble which precipiate with lead. Such precipitation may be involved in preventing lead ion oxidation by hypochlorite. Significantly, however, it has been found that fluoride does not reduce the hypochlorite enamel staining effect in compositions where clay is not present. Also it has been found that other halides such as chloride and other ions which form uncolored precipitates with lead, such as sulfate, do not reduce the hypochlorite staining problem.

Generally, the amount of fluroride source in the compositions of the invention should be sufficient to provide at least 0.01% of soluble fluoride ion to the composition. Preferably the amount of fluoride ion should be of the order of from about 0.1% to about 5%, most preferably from about 0.3% to 2%. All percentages herein are by weight unless specified otherwise. It is generally preferred, although not essential, to have the ratio of fluoride ion to hypochlorite be in the range of 1:10 to 4:1.

The particular source of fluoride chosen for use in the invention is not critical so long as it provides the required amount of fluoride ion.

Water-soluble fluoride salts are the preferred fluoride sources. Preferably, the salts should be colorless, and the cations of the salts should not be oxidizable to colored species by hypochlorite. Examples of suitable salts are the alkali metal fluorides (e.g., sodium, potassium or lithium fluoride), zinc fluoride, stannous fluoride and indium fluoride. The preferred fluorides are the alkali metal fluorides. Other sources of soluble fluoride which can be used are the complex fluorides such as the alkali metal difluorophosphates. The level of fluoride source in the compositions of the invention is generally of the order of greater than about 0.015%, generally from about 0.15% to about 30%. The term "water-soluble" as used herein to describe fluoride sources means having a solubility in the aqueous compositions herein which is sufficient to provide at least 0.01% fluoride ion in the composition at 25° C.

A mineral clay having a cation exchange capacity of at least 3 (preferably at least 40) milliequivalents of cation per 100 grams of clay is another essential component of the compositions of the invention. The cation exchange capacity of clays can be determined by conventional analytical techniques; see, for example, *Soil Science, Vol.* 74, 443-446 (1952), and *Ind. Eng. Chem. Anal. Ed., Vol.* 12, 411–413 (1940). It is believed that the cation exchange function of the clay plays some part in retarding the oxidation and/or precipitation of oxidized lead when compositions of the invention are used on enamel surfaces. The reason why both fluoride ion and clay must be present together to produce a significant reduction of hypochlorite staining on the enamel surface is not understood.

The clay which is used in the compositions of the invention should be relatively unreactive to hypochlorite bleach, particularly if the compositions are to be stored for long periods of time (i.e., more than a few days) prior to use.

Examples of clays suitable for use in the compositions of the invention are kaolinite, halloysite $2H_2O$, halloysite $4H_2O$, smecitite, illite, vermiculite, chlorite, seprolite, attapulgite and polygorskite. The preferred clay is smectite. Smectite clay has a relatively high cation exchange capacity, generally in the range of from about 80 to 150 milliequivalents per 100 grams.

Relatively small amounts of clays, i.e., of the order of 0.1% or so are suitable for use in the compositions for antistaining purposes. It is generally preferable, however, to use at least 1% of clay, generally from 1% to 30%, and most preferably from 2% to 5% clay in the compositions. When used at levels of 1% or more the clays produce a noticeable thickening effect in the compositions. This thickening of the composition makes it possible for the composition to adhere to vertical surfaces without running off. Also, if the composition contains particulate matter, such as abrasive particles in a liquid abrasive cleanser, the thickened system serves to suspend the abrasive in the composition so as to prevent separation. It has also been found that the presence of fluoride salts in thickened abrasive-containing compositions of the invention provides improved phase-stability, i.e., the fluoride salts enhance the ability of the clay-thickened system to hold the abrasive particles in suspension.

When compositions of the invention which contain about 1% or more of clay are subjected to high shear mixing, the clay combines with free water and salts in the composition to form fluid compositions which are false-bodied in nature.

"False-body" fluids are related to but are not identical to fluids having thixotropic properties. True thixotropic materials break down completely under the influence of high stresses and behave like true liquids even after the stress has been removed, until such time as the structure is reformed. False-bodied materials, on the other hand, do not, after stress removal, lose their solid properties entirely and can still exhibit a yield value even though it might be diminished. The original yield value is regained only after such fluids are at rest for considerable lengths of time (See Non Newonian Fluids, Wilkinson, Permagon Press (1960)).

False-body compositions in a quiescent state are highly viscous, are Bingham plastic in nature, and have relatively high yield values. When subjected to shear stresses, however, such as being shaken in a bottle or squeezed through an orifice, these compositions fluidize and can be easily dispensed. When the shear stress is stopped, the compositions quickly revert to a high viscosity/Bingham plastic state.

The formulation of false-body fluid, hypochlorite-containing abrasive cleansers with smectite and attapulgite clays as thickening and suspending agents is more fully described in U.S. Pat. No.. 3,985,668, Hartman, issued Oct. 12, 1976, and the copending application of Hartman, U.S. Ser. No. 415,033, filed Nov. 12, 1973, both incorporated herein by reference.

The cleansing compositions of the invention comprise water, a hypochlorite bleaching agent and the above indicated amounts of fluoride and clay. The amount of hypochlorite bleaching agent in such compositions generally ranges from about 0.1% to about 50%, preferably from about 0.1% to about 10%, and more preferably from about 0.2% to about 5%. The hypochlorite bleaching agent can be any of the wide range of known materals which produce hypochlorite ions in aqueous solution. Examples of such types of materials include the following: alkali metal and alkaline earth metal hypochlorites, hypochlorite addition products, chloramines, chlorimines, chloramides and chlorimides. Specific examples of compounds falling within these general types include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisoycanurate, sodium dichloroisocyanurate dihydrate, 1,3-dichloro-5,5-dimethylhydantoin, N-chlorosulfamide, chlormine T, dichloramine T, chloramine B and dichloramine B. The preferred hypochlorite bleaching agent is sodium hypochlorite.

These bleaches all yield the hypochlorite species in aqueous soltuion. The hypochlorite ion is chemically represented by the formula $OCl^-$. The hypochlorite ion is a strong oxidizing agent and for this reason materials which yield this species are considered to be powerful bleaching agents.

The strength of an aqueous containing hypochlorite ion is measured in terms of available chlorine. This is the oxidizing powr of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, which are the preferred pH levels for the instant compositions, essentially all of the active chlorine is in the form of hypochlorite ion.

In the present compositions water serves as a diluent and as a medium for carrying the hypochlorite and other functional components of the composition. Since it is well known that some transition metal ions, which can react with and deactivate oxidative bleaches, are often present in untreated water, the term "water" for purposes of the present invention means "soft" or deionized water. The amount of water in the present compositions is generally from about 10% to 95%, preferably from about 50% to 90%.

Although the compositions herein can consist simply of the hypochlorite bleaching agent, fluoride salt, clay and water, it is generally preferred for most cleansing applications that the compositions contain additional cleansing material such as surfactants, abrasives, inorganic alkaline salts, sequestering agents and the like. The type and amount of these additional materials which are incorporated into the compositions will be dependent upon the particular cleaning task to which the product is directed.

Surfactants

The compositions of the invention can contain from 0% to about 25% (preferably from about 0.1% to 15% and more preferably from about 0.1% to about 7%) surfactant. The surfactant should be chosen from among those which are compatible with hypochlorite bleach in aqueous media, i.e., surfactants which are relatively stable against decomposition and oxidation by hypochlorite. This is particularly true if the compositions are to be stored before usage. Such bleach stable surfactant materials contain no oxidizable functionalities (such as unsaturation, amino groups, some aromatic structures, or hydroxyl groups) which are susceptible to oxidation by hypochlorite bleaching species.

A preferred class of bleach-stable surfactants is the water-soluble alkyl sulfates containing from about 8 to 18 carbon atoms in the alkyl group. Alkyl sulfates are the water-soluble alkali metal salts of sulfated fatty alcohols. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant compositions include sodium lauryl sulfate, sodium stearyl sulfate, sodium palmityl sulfate, sodium decyl sulfate, sodium myristyl sulfate, potassium lauryl sulfate, potassium stearyl sulfate, potassium decyl sulfate, potassium palmityl sulfate, potassium myristyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl sulfate and sodium lauryl sulfate.

A closely related group of bleach-stable surfactants are the alkali metal paraffin sulfonates containing from about 8 to 22 carbon atoms in the paraffin chain. These are well-known commerically-available surfactants which can be prepared, for example, by the reaction of olefins with sodium bisulfite. Examples are sodium-1-decane sulfonate, sodium-2-tridecane sulfonate and potassium-2-octadecane sulfonate.

A related group of bleach-stable surfactants suitable for use in liquid compositions herein are those having the formula

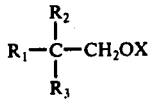

wherein $R_1$, $R_2$ and $R_3$, which can be the same or different, are alkyls of 1 to 18 carbon atoms, the sum of the carbon atoms of $R_1$, $R_2$ and $R_3$ being 10 to 20, and X is $-SO_3M$, $-CH_2COOM$, $-CH_2CH_2COOM$, $-(CH_2CH_2O)_n SO_3M$ or $-(CH_2CH_2O)_nCOOM$, wherein $n$ is from 1 to 40 and M is an alkali metal (e.g., sodium or potassium).

Such compounds are more fully described in U.S. Pat. No. 3,929,661, Nakagawa et al., issued December 30, 1975, and incorporated herein by reference.

Abrasive

Abrasives can be present in the compositions herein at levels from 0% to about 65%.

The abrasives which can be used include any of the substantially water-insoluble paticulate materials conventionally used in abrasive cleansers. Such insoluble materials should have particle size diameters ranging from about 1 to about 250 microns (preferably from 20 to 110 microns) and a specific gravity (as determined by water displacement) of from about 0.2 to 2.2, preferably from about 0.5 to about 0.99.

Examples of such abrasives include, but are not limited to, quartz, pumice, pumicite, titanium dioxide ($TiO_2$), silica sand, calcium carbonate, calcium phosphate, zirconium silicate, diatomaceous earth, whiting, perlite, tripoli, melamine, urea formaldehyde and expanded perlite. Mixtures of different types of abrasive material can also be employed. Silica sand and expanded perlite are the preferred abrasives for use in the instant compositions. Expanded perlite is especially preferred, particularly expanded perlite having a specific gravity from about 0.5 to about 0.99 (See U.S. Pat. No. 3,985,668, issued to W. L. Hartman, October 12, 1976, incorporated herein by reference).

Preferably the abrasive level for the compositions herein ranges from about 2% to 25% by weight, and more preferably from about 3% to 15% by weight.

Inorganic Alkaline Salts

Inorganic alkaline salts are a highly desirable component for the compositions of the instant invention. Such salts can perform several functions. For example, they serve as buffering agents and detergency builders. It is preferred that the alkaline salts or combinations thereof be chosen, both with respect to type and amount, so as to provide a pH of between about 10.5 and 12.5 in usage concentrations of the compositions. This high pH level enhances the stability of the hypochlorite and also provides enhanced detergency performance. Because they are liquid, the compositions of the invention can be used "as is" or be diluted up to about 50% with water.

The alkaline salts can include such materials, for example, as the alkali metal carbonates, bicarbonates, sesquicarbonates, silicates, pyrophosphates, phosphates, orthoborates, tetraborates, and mixtures thereof. Examples of materials which can be used either alone or in combination as the alkaline inorganic salt component of the compositions herein include sodium carbonate, sodium bicarbonate, sodium sesquicarbonate, sodium silicate, tetrapotassium pyrophosphate, trisodium phosphate, tripotassium phosphate, anhydrous sodium tetraborate, sodium tetraborate pentrahydrate and sodium tetraborate decahydrate. Preferred inorganic alkaline salts useful herein include mixtures of tetrapotassium pyrosphosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1 and mixtures of anhydrous sodium carbonate and sodium metasilicate in a carbonate/metasilicate weight ratio of about 3:1.

The inorganic alkaline salts generally comprise from 0% to about 50%, preferably from 1% to about 20%, of the compositions herein.

Along with the alkaline inorganic salts which provide the composition with an alkaline pH, the compositions can optionally also contain neutral salts such as, for example, sodium sulfate and sodium chloride.

Miscellaneous Optional Ingredients

The compositions of the invention can contain various optional ingredients such as perfumes, dyes, sequestering agents (e.g., zerolites), etc., which are stable in the presence of hypochlorite bleach.

Usage

The compositions of the present invention are used on enamel surfaces in the conventional manner of using hard surface cleaning products, i.e., the composition is placed in contact with the soiled surface, optionally rubbed onto the surface so as to provide agitational and frictional forces to facilitate soil loosening, and rinsed to remove the composition and the soil.

The invention will be illustrated by the following examples:

EXAMPLE I

A thickened liquid bleaching composition in accordance with the invention is prepared by dissolving one kilogram of sodium fluoride in 50 kilograms of a commercial aqueous sodium hypochlorite solution (5.25% available chlorine), then blending into this solution 4 kilograms of Gelwhite GP®(a smectite clay from Georgia Kaolin Co.) and adding sufficient soft water to make up 100 kilograms of composition. This composition has less tendency to cause chemical staining of enamel surfaces than a comparable composition which does not contain sodium fluoride.

EXAMPLE II

To the composition of EXAMPLE I is added, with thorough mixing, 6 kilograms of silica sand having a particle size distribution range between 20 and 190 microns. The resulting composition is a thickened liquid abrasive bleach composition which has less tendency to cause chemical staining to enamel surfaces than a comparable composition which does not contain sodium fluride. Similar benefit is obtained when sodium fluoride is replaced by potassium fluoride or zinc fluoride.

EXAMPLE III

A false-body, hard surface abrasive cleanser of the following composition is prepared:

| Component | Wt. % |
|---|---|
| Barasym NAS-100 (Sodium Saponite Smectite Clay) | 4.25% |
| Tetrapotassium Pyrophosphate | 6.0 |
| Tripotassium Phosphate | 2.0 |
| Sodium Hypochlorite Bleach | 0.9 |
| Sodium Lauryl Sulfate Surfactant | 0.25 |
| Expanded Perlite Abrasive (Average Particle Diameter = 50 microns Average Specific Gravity = 0.7) | 6.5 |
| Dye and Perfume | 0.75 |
| Potassium Fluoride | 1.50 |
| Soft Water | Balance |
| | 100.00% |

Composition pH = 11.5

The above-described Example III composition is prepared by first blending the water and clay together and subjecting the mixture to high shear mixing.

Then the remaining ingredients are blended in, forming a false-body fluid. The composition is false-bodied, i,e., gel-like in its quiescent state but easily fluidized by application of shear stress. In its quiescent state, the composition maintains the perlite abrasive in a uniformly suspended dispersion. When applied to horizontal or vertical hard surfaces, the composition is not fluid and does not appreciably run along such surfaces.

Such a composition exhibits negligible clear layer separation and negligible bleach and/or surfactant decomposition over a storage period of six weeks. Such a composition is effective for removal of food stains and soil from hard surfaces, and has a reduced tendency to cause staining by chemical interaction with enamel surfaces than a similar composition which does not contain potassium fluoride. Similar advantage is obtained when potassium fluoride is replaced by sodium fluoride or zinc fluoride.

What is claimed is:

1. An aqueous, hard surface cleansing composition comprising:
   a. from about 0.1% to about 50% of a compound which releases hypochlorite ions in aqueous solution;
   b. from about 0.1% to about 30% of a mineral clay having a cation exchange capacity of at least 3 milliequivalents of cation per 100 grams of clay;
   c. from 0% to about 25% of a surfactant which is compatible with hypochlorite;
   d. from 0% to about 65% of a particulate abrasive having a paticle size of from about 1 to about 250 microns and a specific gravity of from about 0.2 to about 2.2;
   e. from 0% to about 50% of a water-soluble, inorganic alkaline salt or mixture of such salts;
   f. an amount of a source of soluble fluoride ions which provides at least 0.01% of fluoride ions to said composition; and
   g. the balance of said composition comprising water.

2. The composition of claim 1 wherein the clay has a cation exchange capacity of at least 40 milliequivalents of cation per 100 grams of clay and is present in the composition at a level of from about 1% to 30%, wherein the hypochlorite compound is present at a level of from about 0.1% to about 10%, wherein the fluoride source is present at a level which provides at least about 0.1% of fluoride ion to the composition and wherein the ratio of fluoride ion to hypochlorite ion in the composition is from about 1:10 to 4:1.

3. The composition of claim 2 wherein the clay is smectite and is present at a level of from about 2% to 5% and wherein the fluoride source is an alkali metal fluoride.

4. An aqueous, abrasive hard surface cleansing composition comprising:
   a. from about 0.1% to about 30% of a mineral clay having a cation exchange capacity of at least 3 milliequivalents of cation per 100 grams of clay;
   b. from about 2% to about 25% by weight of a particulate abrasive material, substantially all of said material ranging in particle size from 1 micron to about 250 microns, said material having an average specific gravity ranging from about 0.2 to 2.2;
   c. from about 0.1% to about 10% of a bleaching agent which releases hypochlorite ions in aqueous solution;
   d. a source of fluoride ion in sufficient amount to provide at least about 0.01% fluoride ion in said composition;
   e. from about 1% to about 20% of an alkaline inorganic salt or mixture of such salts;

f. from 0% to about 25% of a surfactant which is compatible with hypochlorite; and g. the balance of said composition comprising water.

5. The composition of claim 4 wherein the fluoride source is a water-soluble fluoride salt and said salt is present in sufficient quantity to provide at least 0.1% of fluoride ion in said composition, wherein the clay has a cation exchange capacity of at least 40 milliequivalents of cation per 100 grams of clay and wherein said clay is present in said composition at a level of from about 1% to about 30%, and wherein the ratio of fluoride ion to hypochlorite ion is from about 1:10 to 4:1.

6. The composition of claim 5 wherein the fluoride salt is selected from the group consisting of alkali metal, zinc, stannous and indium fluorides and wherein the clay is smectite.

7. The composition of claim 6 wherein the fluoride is an alkali metal fluoride and wherein the smectite clay is present at a level of from about 2% to about 5%.

8. The composition of claim 7 wherein the surfactant is present at a level of from 0.1% to 15% and is selected from the group consisting of alkali metal, $C_8$–$C_{18}$ alkyl sulfates, alkali metal, $C_8$–$C_{22}$ paraffin sulfonates and compounds of the formula

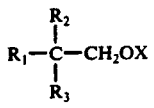

wherein $R_1$, $R_2$ and $R_3$ can be the same or different and are alkys of 1 to 18 carbon atoms, the sum of the carbon atoms of $R_1$, $R_2$ and $R_3$ being from 10 to 20, wherein X is $SO_3M$, $CH_2COOM$, $CH_2CH_2COOM$, $—(CH_2CH_2O)_nSO_3M$, or $—(CH_2CH_2O)_nCOOM$, wherein *n* if from 1 to 40 and M is an alkali metal.

9. The composition of claim 8 wherein the surfactant is selected from the group consisting of $C_8$–$C_{18}$ alkyl sulfates and $C_8$–$C_{22}$ paraffin sulfonates.

10. A composition in accordance with claim 9 wherein the inorganic salt or salt mixture serves to buffer the composition to a pH of from about 10.5 to about 12.5.

11. A composition in accordance with claim 10 wherein a. the surfactant is an alkali metal $C_8$–$C_{18}$ alkyl sulfate;

b. the alkaline inorganic salt component is selected from the group consisting of water-soluble carbonates, bicarbonates sesquicarbonates, silicates, pyrophosphates, phosphates, tetraborates, and mixtures thereof;

c. the bleaching agent is selected from the group consisting of alkali metal hypochlorites, alkaline earth metal hypochlorites, hypochlorite addition products, chloramines, chlorimines, choramides, and chlorimides and is present to the extent of from about 0.2% to 5% by weight of the composition; and d. the abrasive is an expanded perlite having a specific gravity of from about 0.5 to 0.99 and is present at a level of from about 3% to 15% of the composition.

* * * * *

UNITED STATES PATENT AND TRADEMARK OFFICE

CERTIFICATE OF CORRECTION

PATENT NO. : 4,051,055

DATED : September 27, 1977

INVENTOR(S) : Toan Trinh and Bruce Albert Yeazell

It is certified that error appears in the above-identified patent and that said Letters Patent are hereby corrected as shown below:

Col. 1, after the title "CLEANSING COMPOSITIONS" and before line 5, insert -- BACKGROUND OF THE INVENTION -- .

Col. 2, line 21, "which precipiate" should be -- white precipitate --.

Col. 7, line 5, "zerolites" should be -- zeolites --.

Col. 7, line 39, "fluride" should be -- fluoride --.

Col. 7, line 64, "remainding" should be -- remaining --.

Col. 10, line 2, "alkys" should be -- alkyls --.

Col. 10, line 5, "if" should be -- is --.

Signed and Sealed this

Second Day of May 1978

[SEAL]

Attest:

RUTH C. MASON
Attesting Officer

LUTRELLE F. PARKER
Acting Commissioner of Patents and Trademarks